US007489085B2

(12) United States Patent
Chou et al.

(10) Patent No.: US 7,489,085 B2
(45) Date of Patent: Feb. 10, 2009

(54) BACKLIGHT MODULE ACTUATION METHOD

(75) Inventors: Chin-Wen Chou, Taipei Hsien (TW); Ying-Nan Cheng, Taipei Hsien (TW); Ying-Chang Cheng, Taipei Hsien (TW); Chin-Biau Chung, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 592 days.

(21) Appl. No.: 11/314,000

(22) Filed: Dec. 22, 2005

(65) Prior Publication Data

US 2007/0145906 A1 Jun. 28, 2007

(51) Int. Cl.

| | |
|---|---|
| ***G09G 3/10*** | (2006.01) |
| ***G09G 3/36*** | (2006.01) |
| *G09G 3/30* | (2006.01) |

(52) U.S. Cl. ..... 315/169.3; 345/102; 345/77

(58) Field of Classification Search ..... 315/169.3, 315/169.4; 345/76–77, 78, 102

See application file for complete search history.

(56) References Cited

U.S. PATENT DOCUMENTS

| | | | | |
|---|---|---|---|---|
| 6,570,344 | B2 * | 5/2003 | Lin | 315/224 |
| 6,798,151 | B1 * | 9/2004 | Chou et al. | 315/169.3 |
| 6,812,916 | B2 * | 11/2004 | Hwang | 345/102 |
| 7,044,629 | B2 * | 5/2006 | Moon | 362/634 |
| 7,208,885 | B2 * | 4/2007 | Hsu | 315/291 |

* cited by examiner

*Primary Examiner*—Douglas W. Owens
*Assistant Examiner*—Minh A
(74) *Attorney, Agent, or Firm*—Muncy, Geissler, Olds & Lowe, PLLC

(57) ABSTRACT

A backlight module actuation method aims to modulate a unsaturated luminance cycle in a dimming cycle for a backlight module in the condition of a saturated luminance. An oscillation amplitude time series of the duty cycle of a transformer at the rear end is set according to the dimming cycle to form a switch kinetic energy in the unsaturated luminance cycle. The switch kinetic energy can eliminate the parasite capacitance generated when the backlight module is in the condition of the saturated luminance.

7 Claims, 5 Drawing Sheets

BACKLIGHT MODULE ACTUATION METHOD

FIELD OF THE INVENTION

The present invention relates to a backlight module actuation method and particularly to an actuation method that regulates an unsaturated luminance cycle in a saturated luminance condition of a backlight module to generate switch kinetic energy for a transformer to eliminate parasite capacitance.

BACKGROUND OF THE INVENTION

In the technology of display devices, the backlight module plays an important role. It generates a uniform luminance to present more crisp colors for a display panel. However, the backlight module generally is driven by high voltage. In the event that the current of the backlight module is not stable or maintains a saturated luminance for a long period of time, a scattering parasite capacitance effect occurs. This not only affects the entire luminance, the displaying picture of the display panel also fluctuates. This is not desirable to viewer's vision.

To remedy the problem of parasite capacitance, U.S. Pat. No. 6,798,151 discloses a technique to neutralize the leaking current and charges generated by parasite capacitance between the display device and the backlight module so that the phenomenon of unbalanced current flowing through lamp tubes caused by the leaking current is eliminated. And the light source of the lamp tubes can be maintained evenly to enable the display panel to get a uniform luminance in a wider range. That patent has an external metal mask on a display panel module to receive directly or through a linking element a signal, or a plastic middle layer in the external metal mask to receive the signal, thereby to eliminate, neutralize or offset the residual charges on the display panel.

But the aforesaid approach merely partly solves the problem. When the scattering parasite capacitance is generated, the display panel is already being interfered. And when the display luminance is saturated in normal conditions, the parasite capacitance exists almost constantly. Hence the aforesaid patent cannot neutralize or eliminate the parasite capacitance instantly. As a result, the picture quality suffers.

SUMMARY OF THE INVENTION

Therefore the primary object of the present invention is to solve the aforesaid disadvantages. The present invention provides a modulated unsaturated luminance cycle in a dimming cycle of a backlight module in a saturated luminance condition. And an oscillation amplitude time series of the duty cycle of a transformer at the rear end is set according to the dimming cycle and a switch kinetic energy is formed in the unsaturated luminance cycle. The switch kinetic energy can eliminate the parasite capacitance while the backlight module is in the saturated luminance condition.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
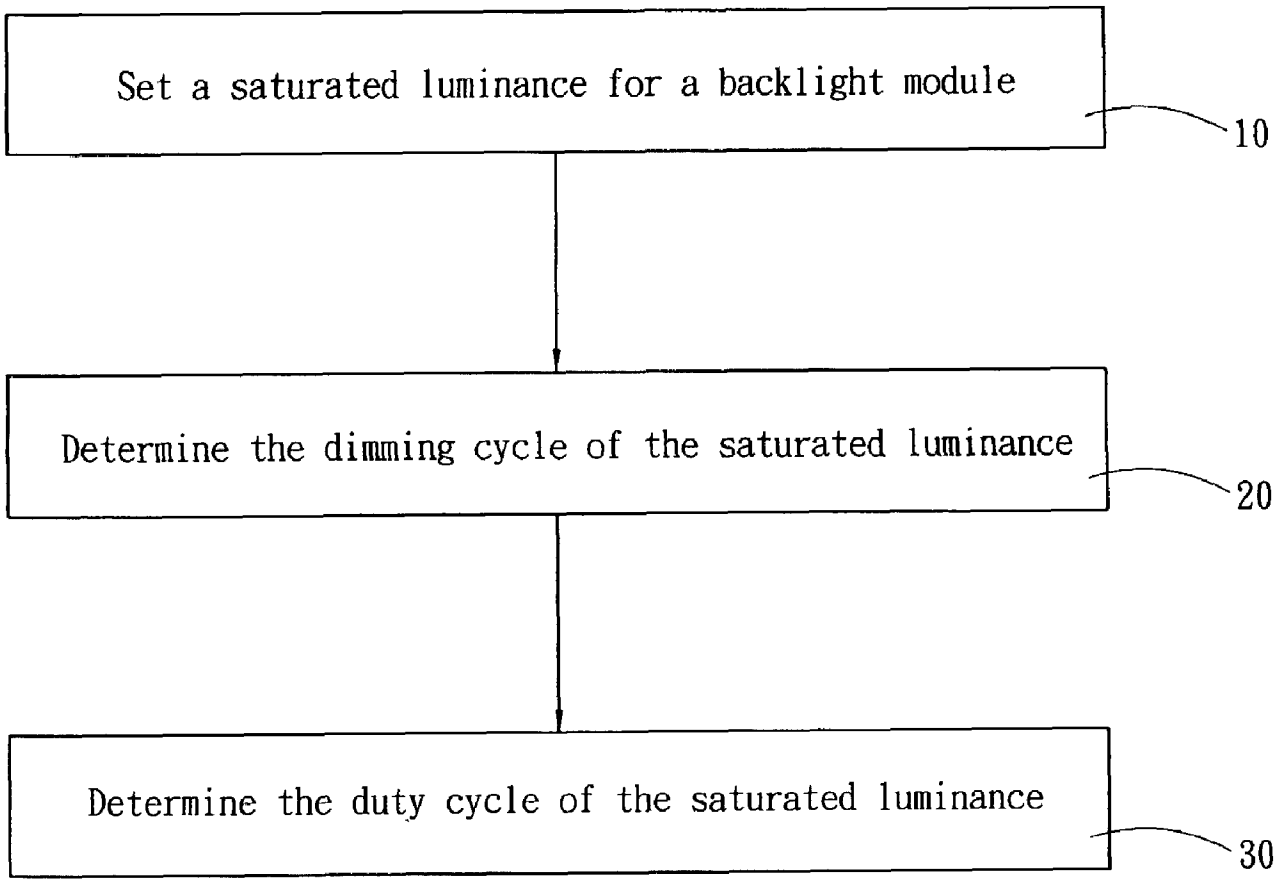
FIG. 1 is a flow chart of the method of the present invention.
Figure 2:
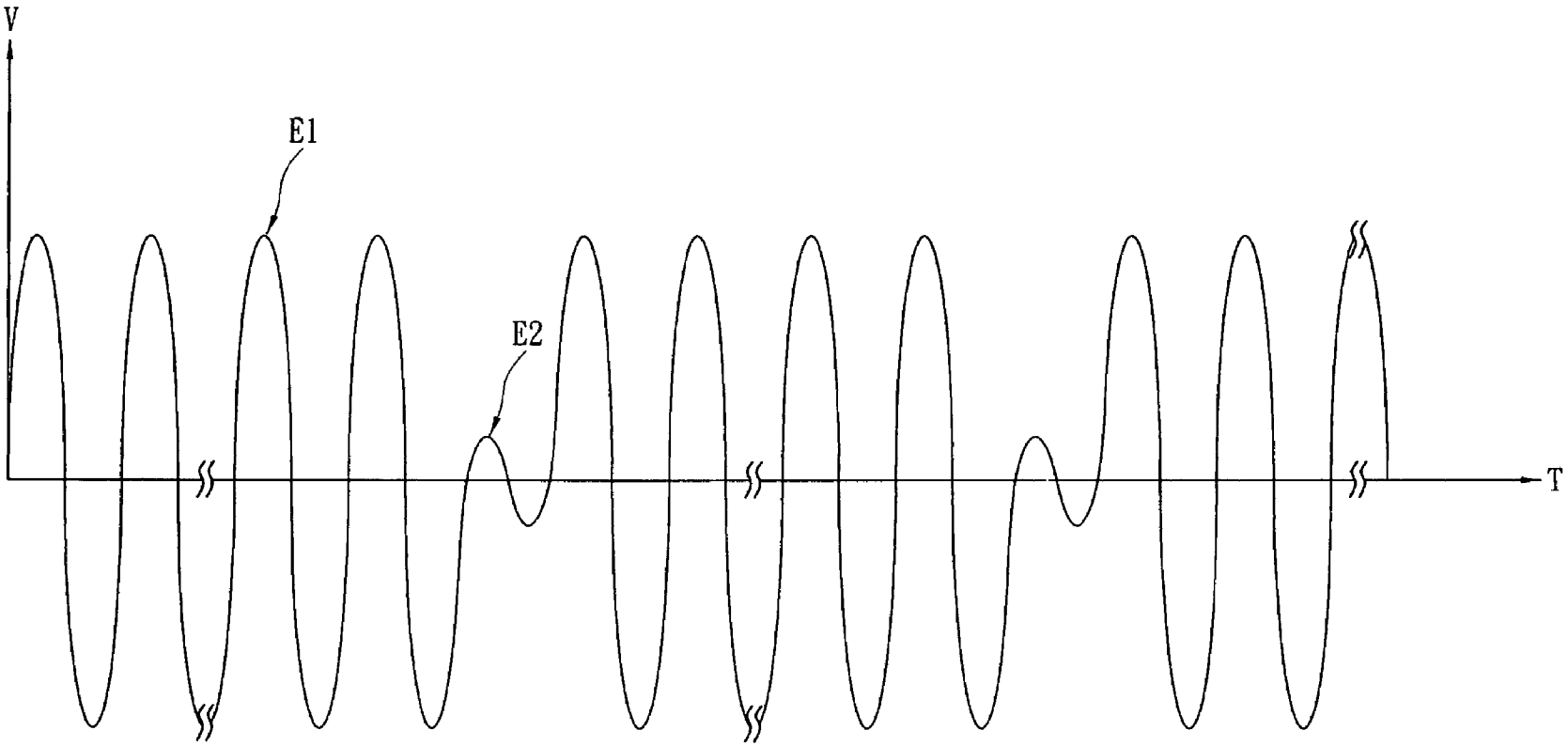
FIG. 2 is a schematic view of the duty cycle of a transformer of the present invention.
Figure 3:
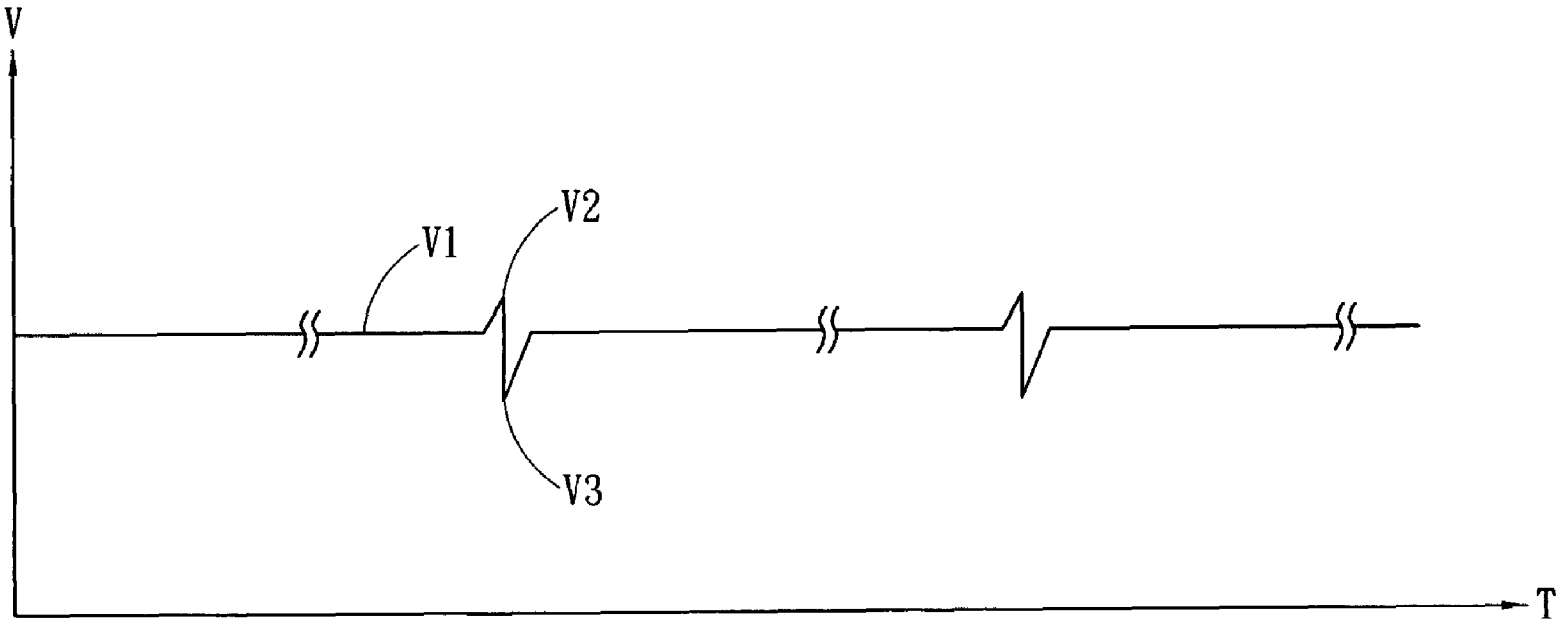
FIG. 3 is a schematic view of energy output by the transformer of the present invention.
Figure 4:
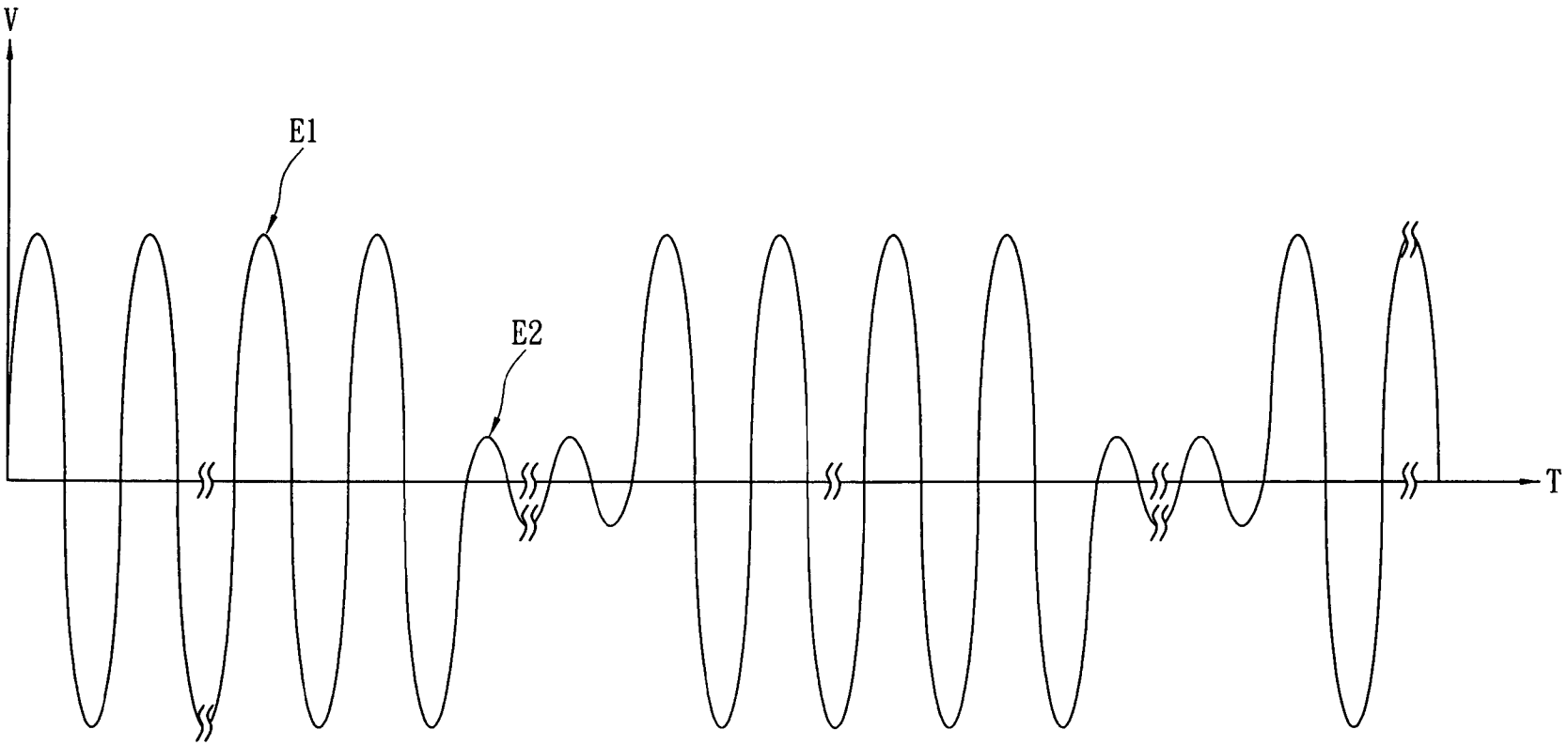
FIG. 4 is a schematic view of the duty cycle of another transformer of the present invention.
Figure 5:
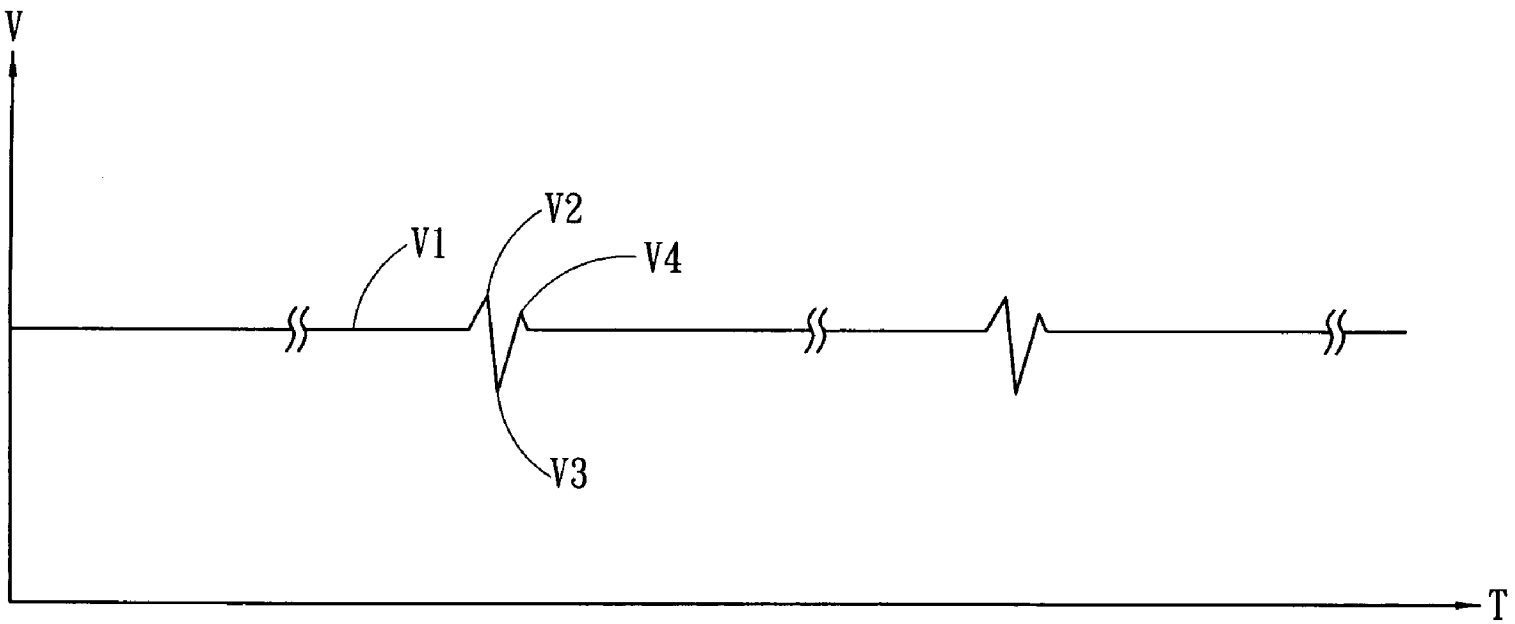
FIG. 5 is a schematic view of energy output by another transformer of the present invention.

Please referring to FIGS. 1, 2 and 3, the backlight module actuation method according to the invention includes:

setting a saturated luminance 10 of a backlight module: The saturated luminance generally means the maximum setting brightness presentable on the backlight module. Presenting of the brightness usually is defined by the kinetic energy outputable by a transformer at the rear end or the maximum driving kinetic energy sustainable by the backlight module. The maximum saturated luminance has varying limitations based on different material characteristics of the backlight module. In this invention the saturated luminance is defined by the scattering parasite capacitance occurred in the maximum driving kinetic energy sustainable by the backlight module;

determining a dimming cycle 20 of the saturated luminance and modulating a unsaturated luminance cycle E2 in a dimming cycle E1: The dimming cycle E1 is the maximum brightness value set for the backlight module. In the present techniques, the dimming cycle E1 defines every pulse signal to oscillate at the maximum amplitude of the same voltage. Output is mostly in the form of square waves output by a pulse-width modulator (PWM). To facilitate discussion of the technical features of the invention, the dimming cycle E1 and duty cycle are presented in sinusoidal waves; and determining a duty cycle 30 of the saturated luminance: The present invention sets an oscillation amplitude time series of the duty cycle of the transformer at the rear end based on the dimming cycle E1 to output kinetic energy to drive the backlight module. As the unsaturated luminance cycle E2 is modulated in the dimming cycle E1 of the saturated luminance, a switch kinetic energy is formed in the unsaturated luminance cycle E2 of the duty cycle of the transformer. Based on different width of the unsaturated luminance cycle E2 (or so called pulse wave composition), (such as the unsaturated luminance cycle E2 of a single pulse wave shown in FIG. 2, and the unsaturated luminance cycle E2 of multiple pulse waves shown in FIG. 4), or different parameters such as duty frequency of different transformers, frequency of the dimming cycle E1 and potential difference between an oscillation amplitude kinetic energy V3 of the setting unsaturated luminance and an oscillation amplitude kinetic energy V1 of the saturated luminance, the switch kinetic energy could be different as shown in FIG. 3, in which the switch kinetic energy includes an oscillation amplitude kinetic energy V2 of an over-saturated luminance and an oscillation amplitude kinetic energy V3 of a unsaturated luminance; or as shown in FIG. 5, in which the switch kinetic energy includes an oscillation amplitude kinetic energy V2 of an over-saturated luminance, an oscillation amplitude kinetic energy V3 of a unsaturated luminance and another oscillation amplitude kinetic energy V4 of the over-saturated luminance. In an embodiment of the invention, the oscillation amplitude kinetic energy V3 of the unsaturated luminance is not zero potential to avoid damage that might occur during kinetic energy transformation of the transformer. Through the switch kinetic energy, the actual duty condition of the backlight module is not in the condition of constant saturated luminance. Namely, through the switch kinetic energy of the transformer, the original oscillation amplitude kinetic energy V1 of the saturated luminance of the backlight module can form an ON/OFF switch effect to eliminate the parasite capacitance that might otherwise occur when the backlight module is in the saturated luminance condition.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A backlight module actuation method, comprising:

setting a saturated luminance for a backlight module;

determining a dimming cycle of the saturated luminance and modulating a unsaturated luminance cycle in the dimming cycle; and determining a duty cycle of the saturated luminance and setting an oscillation amplitude time series of another duty cycle of a transformer at a rear end according to the dimming cycle to output a kinetic energy to drive the backlight module, and forming a switch kinetic energy for the transformer in the unsaturated luminance cycle to eliminate parasite capacitance generated in the backlight module in the condition of the saturated luminance.

2. The backlight module actuation method of claim 1, wherein the switch kinetic energy of the transformer includes a first oscillation amplitude kinetic energy of an over-saturated luminance and a second oscillation amplitude kinetic energy of the unsaturated luminance.

3. The backlight module actuation method of claim 2, wherein the second oscillation amplitude kinetic energy of the unsaturated luminance and the first oscillation amplitude kinetic energy of the over-saturated luminance have a potential difference which is determined by the width of the unsaturated luminance cycle.

4. The backlight module actuation method of claim 2, wherein the second oscillation amplitude kinetic energy of the unsaturated luminance is not zero potential.

5. The backlight module actuation method of claim 1, wherein the switch kinetic energy of the transformer includes a first oscillation amplitude kinetic energy of an over-saturated luminance, a second oscillation amplitude kinetic energy of the unsaturated luminance and a third oscillation amplitude kinetic energy of the over-saturated luminance.

6. The backlight module actuation method of claim 5, wherein the second oscillation amplitude kinetic energy of the unsaturated luminance and the first and the third oscillation amplitude kinetic energy of the over-saturated luminance have potential differences which are determined by the width of the unsaturated luminance cycle.

7. The backlight module actuation method of claim 5, wherein the second oscillation amplitude kinetic energy of the unsaturated luminance is not zero potential.

* * * * *